United States Patent [19]

Malmgren

[11] Patent Number: 4,571,137

[45] Date of Patent: Feb. 18, 1986

[54] DEVICE FOR SUPPLYING SOLID FUEL TO A FURNACE

[75] Inventor: Bengt-Göran Malmgren, Åkarp, Sweden

[73] Assignee: HB BGM Innovation, Sodervagen, Sweden

[21] Appl. No.: 461,757

[22] Filed: Jan. 28, 1983

[30] Foreign Application Priority Data

Jan. 29, 1982 [SE] Sweden ..... 8200499

[51] Int. Cl.[4] ..... F23K 3/00

[52] U.S. Cl. ..... 414/173; 414/198; 110/101 A; 110/101 R; 110/108; 110/114; 110/289

[58] Field of Search ..... 414/160, 172, 173, 198; 222/216, 217, 367; 110/101 A, 101 R, 105, 108, 114, 289, 293

[56] References Cited

U.S. PATENT DOCUMENTS

| | | | |
|---|---|---|---|
| 444,249 | 1/1891 | Mitchell | 414/172 |
| 1,524,356 | 1/1925 | Hübner | 414/173 |
| 1,960,435 | 5/1934 | Dudley | 222/216 X |

FOREIGN PATENT DOCUMENTS

| | | | |
|---|---|---|---|
| 2072623 | 10/1981 | United Kingdom | 222/216 |
| 119346 | 3/1958 | U.S.S.R. | 414/160 |

*Primary Examiner*—Joseph E. Valenza
*Assistant Examiner*—David A. Bucci
*Attorney, Agent, or Firm*—Merchant, Gould, Smith, Edell, Welter & Schmidt

[57] ABSTRACT

A device for supplying solid fuel to a furnace comprises a cell wheel (16) for receiving fuel portions in the cells (19) open axially. The cell wheel is rotatably mounted between two stationary end walls (12, 13) forming two openings (20, 21) facing each other, one of the end walls having an outlet socket (23) at the opening therein. A mechanism (27, 33) is provided to rotate the cell wheel step by step, and a transfer element (50, 51) is displaceable through a cell when located between the openings, for supplying the fuel contained therein through the outlet socket to the furnace. A shut-off member (43) is provided to shut off the passage through the socket in co-ordination with the movement of the transfer element.

2 Claims, 4 Drawing Figures

DEVICE FOR SUPPLYING SOLID FUEL TO A FURNACE

The invention relates to a device for supplying solid fuel to a furnace comprising a cell wheel rotatable about a substantially horizontal axis between two stationary end walls, for receiving fuel portions in the cells open axially and available for filling at a position in the path of rotation of the cell wheel, said end walls forming two openings facing each other axially, for uncovering a through passage through a cell located between said openings.

The high oil prices have brought up an increased use of solid fuels for the heating of housings and other premises. For coal and coke so-called stokers can be used for automatic supply of the fuel to the furnace, and also for chippings and sawdust automatic firing devices are available. As far as firewood is concerned, either in the form of split firewood or waste pieces from the wood working industry or board pieces from tearing downs, and also as far as peat, paper and all other solid fuels are concerned it is however necessary to fire manually, which means that solid fuels in this category cannot be utilized in the manner and to the extent as is desired.

The object of the invention is to provide a device for supplying solid fuel to a furnace which can operate not only with coal, coke, chippings, sawdust, peat and paper but also with wooden fuel in larger pieces and which can easily be made automatic in order to take care of the supply of fuel for an extended period without attendance. According to the invention, this object has been achieved by the device having obtained the characteristics appearing from claim 1.

Figure 1:
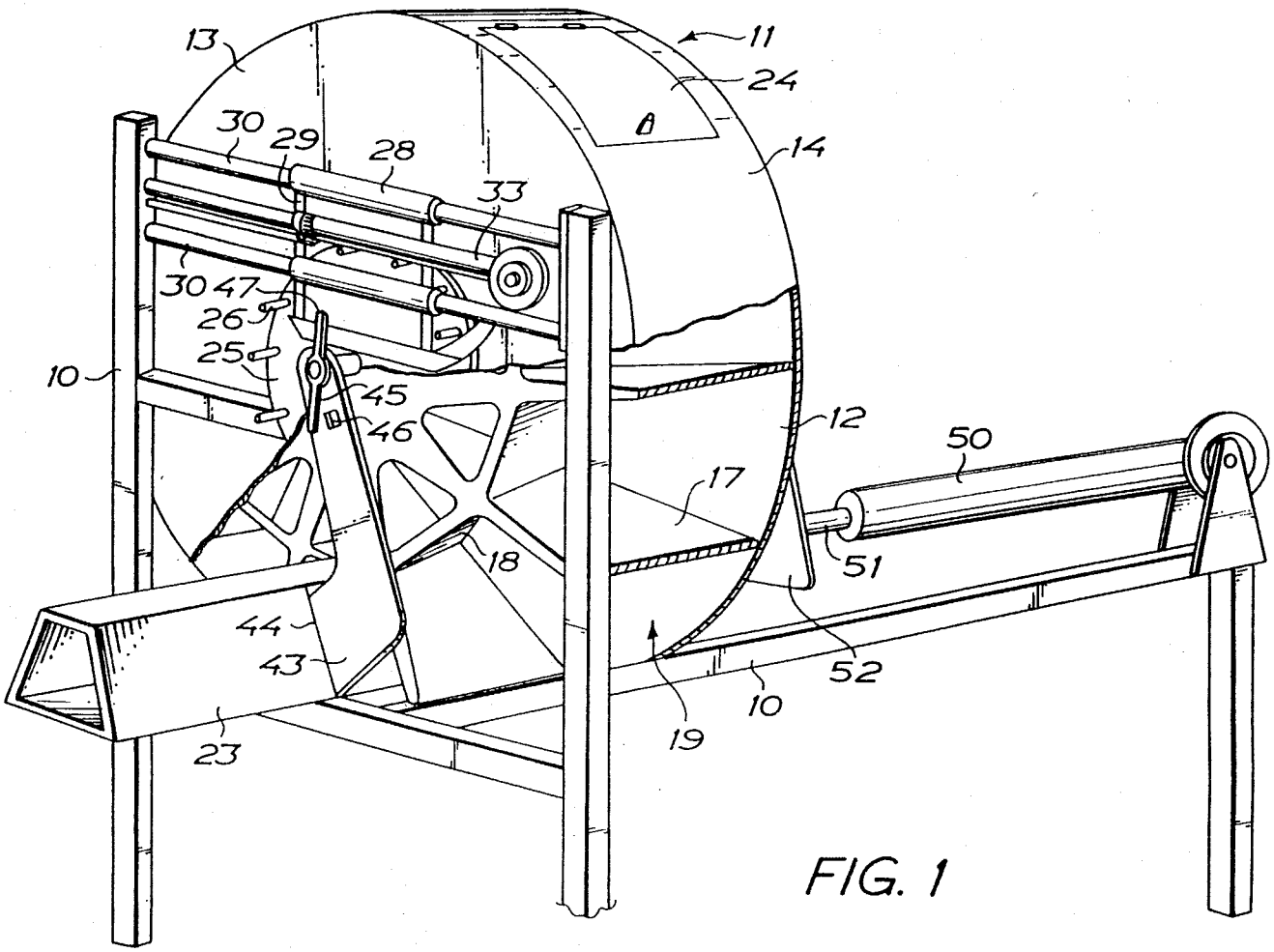
Figure 2:
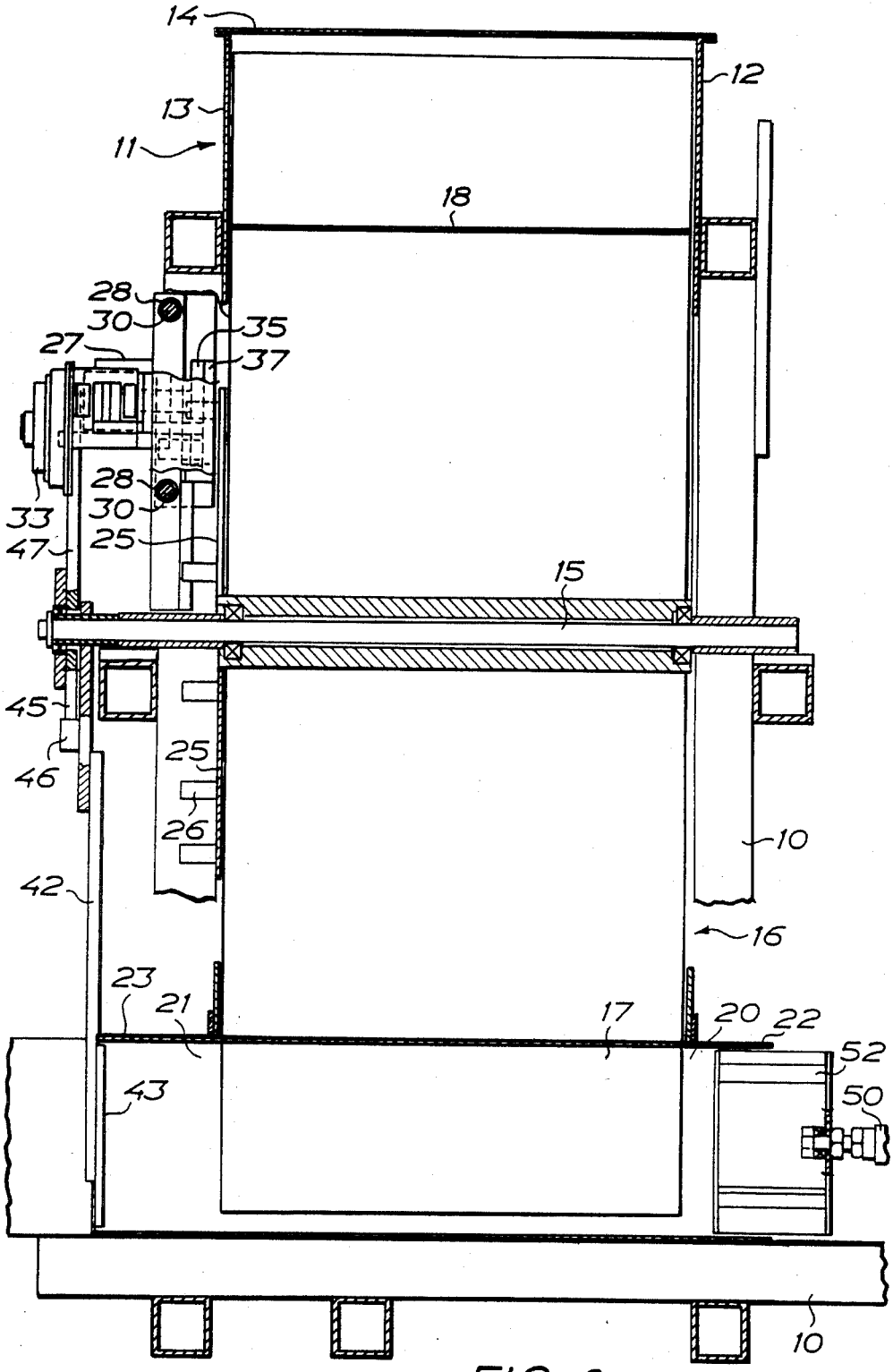
Figure 3:
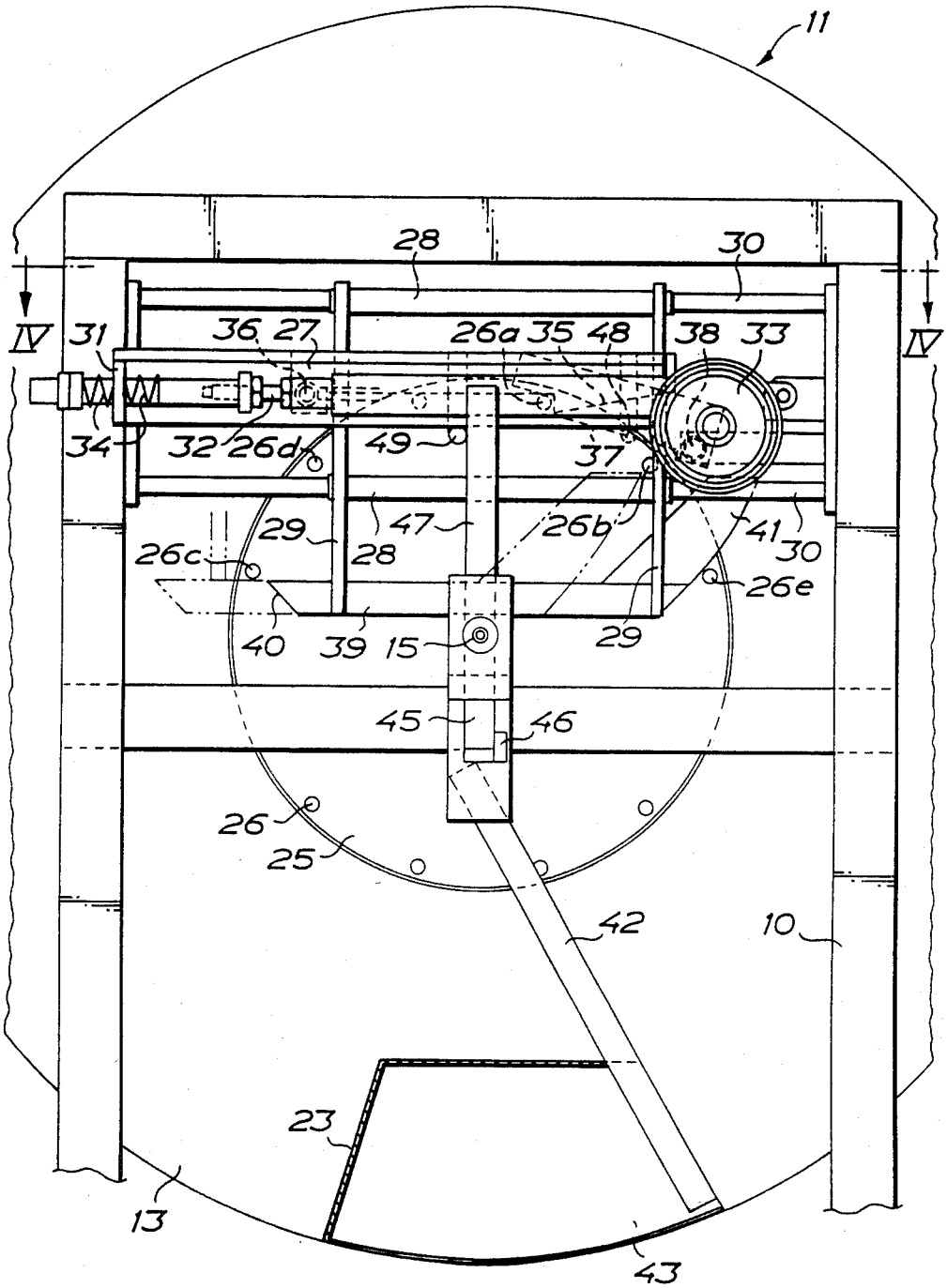
Figure 4:
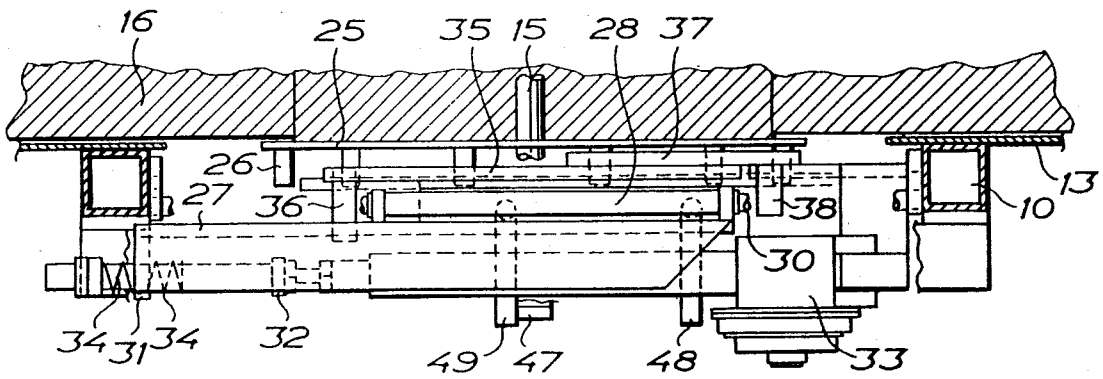

In order to explain more closely the invention an illustrative embodiment thereof will be described in more detail below with reference to the accompanying drawings in which FIG. 1 is a somewhat diagrammatic perspective view, partly broken away, of the supplying device, FIG. 2 is a vertical sectional view of the device, FIG. 3 is a front view of the device as seen from the outlet side thereof, and FIG. 4 is a cross-sectional view along line IV—IV in FIG. 3.

Referring to the drawings, the device comprises a beam frame 10 supporting a cylindrical housing 11 having two end walls 12 and 13 axially facing each other, and a curved wall 14. A shaft 15 is connected centrally to the end walls, and a cell wheel 16 is rotatably journalled on said shaft inside the housing. This cell wheel comprises a number of equally spaced wings 17 interconnected by webs 18, each pair of said wings forming together with a web therebetween a cell 19 which is open at three sides. An opening 20 and 21, respectively, is formed in each end wall at the lower end thereof, said openings facing each other axially and having a shape which corresponds substantially to the cross-sectional shape of a cell. On the outside of each end wall a socket 22 and 23, respectively, is connected to said opening. Moreover, the housing has a door 24 at the top thereof, which can be opened and which is sufficiently large to uncover at least one cell. This door can be arranged at another location on the housing e.g. in the rear end wall 12. A disc 25 having a number of pins 26 equally spaced on a circle is mounted to the cell wheel and is received by an opening in the end wall 13. This disc forms part of a drive mechanism for rotating the cell wheel step by step.

The drive mechanism also comprises a slide 27. By me4ns of sockets 28 connected to cross bars 29 on the slide this is displaceably mounted on two guide bars 30 parallel to each other, which are mounted in the frame 10 at the ends thereof. At a lug 31 the slide is connected to a reciprocable rod 32 of a control unit 33 which can comprise a pneumatic or hydraulic cylinder or a control unit driven by an electric motor and having a reciprocating movement such as an SKF Actuator. It is a control unit of the last-mentioned type that is shown in the drawings. The control unit is supported by the frame and the connection between the rod 32 thereof and the slide is made elastic by the lug 31 being arranged between two compression springs 34 secured to the rod.

A drive pawl 35 is pivoted to the slide at 36 while a latch pawl 37 is pivoted to the frame at 38. These pawls are arranged to engage the pins 26 on the cell wheel as will be seen from FIG. 3. Moreover, the slide is provided with a rail 39 supported by the cross bars 29, which is chamfered at one end thereof at 40 and has a cam 41 at the other end thereof. The slide 27 is shown in the right hand end position thereof by solid lines in FIG. 3, and if the slide is displaced to the left from this position by means of the control unit 33, the cell wheel 16 will be carried along by the engagement of the drive pawl with the pin 26*a*, while the latch pawl 37 disengages this pin so as to slide on top of the pin 26*b*. During the rotation of the cell wheel at the displacement of the slide to the left the pin 26*c* will clear the rail 39 at the chamfered end 40 thereof while the rail will be displaced into the path of movement of the pins 26 between the pin 26*c* and the pin 26*d*. Considering the joint movements of the slide and the cell wheel the cam 41 is formed such that the pin 26*e* follows the cam 41 engaging that cam, at the movement of the cell wheel obtained when the slide is being displaced to the left from the position shown in FIG. 3. When the slide has arrived at the left end position thereof which is partly indicated in FIG. 3 by dot and dash lines, the pin 26*d* will abut the rail 39 displaced into the path of movement of the pins, or will be in the proximity thereof while the pin 26*e*, now taking the position of the pin 26*b* shown in the drawing, has left the cam 41 at the upper end thereof. Moreover, the latch pawl 37 has pivoted to engage the pin 26*b* which is now in the same position as the pin 26*a* in FIG. 3, and accordingly the slide can now return to the right hand end position thereof while the drive pawl 35 slides onto the pin 26*b* and finally engages said pin without the cell wheel then being carried along by the slide. The stroke of the slide is dimensioned such that the cell wheel at each stroke will be rotated over an angle which corresponds to the pitch of the cells 19. The movement of the cell wheel in clockwise direction at each stroke of the slide from the right to the left is fully controlled by the slide due to the fact that one of the pins 26, in the sequence of movements described the pin 26*e*, continuously follows the cam 41 and another pin, in the sequence of movements described the pin 26*d*, will engage the rail 39 when the pin 26*e* has come out of contact with the cam 41. In this manner the cell wheel is prevented from self-rotation in clockwise direction e.g. due to the cell wheel being loaded to a greater extent at the left side in FIG. 3 than at the right side.

An arm 42 is mounted to be free for swinging movement on the shaft 15, and at the lower end thereof said arm carries a sliding gate 43 which can be inserted into the socket 23 through an opening 44 therein in order to shut off the passage through the socket. Also a double-arm lever is pivotally mounted on the shaft 15. One arm 45 of this lever, pointing downwards, co-operates with an abutment 46 on the arm 42 while the other arm 47 of the lever, pointing upwards, co-operates with two abutments 48 and 49 on the slide. When the slide is displaced from the right to the left in FIG. 3, the abutment 48 will engage the arm 47 at the end of the stroke of the slide, the lever 45, 47 being rotated in counter-clockwise direction and carrying along the arm 42 in the movement thereof due to engagement of the arm 45 at the abutment 46. By the rotation of the arm 42 the gate 43 is displaced out of the socket 23 in order to uncover the passage through said socket, that part of the slide movement during which the abutment 48 engages the arm 47, being sufficiently large to provide the necessary angular movement of the arm 42. At the return of the slide from the left to the right the arm 42 rotates in clockwise direction by gravity or by means of spring bias and carries along the lever 45, 47 in the movement thereof. However, the abutment 49 can return the lever 45, 47 to the position shown in FIG. 3 by engaging the arm 47. If there should be an obstacle to the insertion of the gate 43 into the socket 23, no breaking of the lever system will take place because the arm 45 can move unobstructedly from the abutment 46 in clockwise direction and leave the arm 42 behind (cfr FIG. 1).

A control unit 50 supported by the frame, which can be pneumatic, hydraulic or electric and as shown here is an SKF Actuator haVing a reciprocable rod 51, is mounted to the frame 10. The rod 51 has a plunger 52 the shape of which is substantially in agreement with the cross-sectional form of the cells 19, and the control unit 50 has such a stroke that the piston can be displaced from the position in the socket 22 shown in FIG. 2 through the cell 19 located opposite to the openings 20 and 21, and further through the socket 23 to the outer end thereof. The plunger 52 thus forms a transfer element for feeding out the material in the cells 19 through the socket 23.

When the device described is being used the cells 19 of the cell wheel 16 initially are filled with a solid fuel such as firewood pieces by the door 24 being opened and the cells 19 one after the other being brought into position opposite to the door opening by the cell wheel being advanced step by step. The socket 23 should open in the furnace in which the fuel is to be burnt. It is assumed that the slide 27 has been displaced from the right hand end position shown in FIG. 3 to the left hand end position such that the gate 43 is open. By displacement of the plunger 52 forwards by means of the control unit 50 the fuel in the cell 19 opposite to the openings 20 and 21 can be displaced by means of the plunger 52 from the cell through the socket into the furnace. When the plunger 52 has been returned to the position shown in FIG. 2, the slide returns to the right hand end position shown in FIG. 3, the gate 43 being closed. After a predetermined period the operation is repeated, the cell wheel being advanced one step at the displacement of the slide from the right to the left as seen in FIG. 3 so that another cell filled with fuel will be positioned opposite to the openings 20 and 21. As will be understood an increasing number of cells at the right hand side of the cell wheel as seen in FIG. 3 will be empty as fuel is being supplied to the furnace, while the cells at the left side are filled with fuel, the cell wheel as a consequence thereof will tend to rotate by itself in counter-clockwise direction as seen in FIG. 3. However, the rail 39 and the cam 41 prevent the cell wheel from rotating by itself during an advancing step as explained above; the movement is continuously controlled by the slide.

The socket 23 which extends between the housing 11 of the fuel supplying device and the furnace can form an extension of the combustion space of the furnace if the plunger in the forward position thereof is allowed to return as soon as it has passed the gate 43. Then, the advantage is achieved that it is possible to fire with fuel pieces which are longer than the fuel pieces for which the furnace is constructed, because these longer fuel pieces can be received partly in the combustion space and be combusted therein and partly in the socket 23. This provides a reduction of the firing costs because it is not necessary to divide the solid fuel into pieces to the same extent as when the combustion space of the furnace only is available for receiving the fuel.

The operations of the fuel supplying device can be controlled automatically from program control means, the interval between two operations for supplying fuel to the furnace following one after the other being defined by a timer or by the combustion process e.g. the furnace temperature.

In the embodiment shown the curved wall 14 is fixedly connected to the end walls 12 and 13 to form together with these walls a stationary housing. In an alternative embodiment the curved wall is fixedly connected to the cell wheel at the outer edges of the wings 17, said wall thus forming together with the cell wheel a unit rotatable between the end walls. For the filling of the cells an aperture is then provided in the end wall 12, through which the cells are available from one end thereof at a suitable position in the path of rotation of the cell wheel. e.g. an aperture can be provided adjacent the socket 22 at one side or the other thereof such that the filling can take place at a comfortable level and it is not necessary to lift the fuel as high as when the filling takes place at the door 24. Another advantage of arranging the curved wall on the cell wheel is that small pieces of fuel or objects accompanying the fuel cannot jam between the cell wheel and the curved wall.

I claim:

1. A device for supplying solid fuel to a furnace comprising a cell wheel rotatable about a substantially horizontal axis, for receiving fuel portions in the cells which are open axially and available for filling at a position in the path of rotation of the cell wheel, two stationary end walls, said cell wheel being rotatably mounted between said end walls which form two openings facing each other axially, for uncovering a through passage through a cell located between said openings, said openings being dimensioned so as to uncover the total cross section of the cell, and an outlet socket on one of said end walls at the opening therein, a drive mechanism, including a pawl and ratchet mechanism with a ratchet on the cell wheel coaxially aligned with the axis therefor, and a slide reciprocal in the transverse direction of the axis, which carries a drive pawl for co-operation with the ratchet, connected to the cell wheel for rotating the cell wheel step by step to locate the cells one after the other opposite to said openings, a reciprocable transfer means at the side of the cell wheel where the other end wall is located, which is displaceable through the cell located between the openings and through the outlet socket for supplying the fuel received by the cell through the socket, and a displaceable shut-off member for shutting off the passage through the outlet socket and which is operatively connected with the slide to be moved to an opened position by an operative stroke of the slide and to a closed position by a return stroke of the slide, said shut-off member as to the displacement thereof being co-ordinated with the movement of the transfer means to shut off the passage through the socket when the transfer means is withdrawn.

2. A device as claimed in claim 1 further comprising a lever mounted for fundamental movement about the axis of the cell wheel, said shut-off member being mounted on said lever, and an abutment on said slide for co-operation with the lever.

* * * * *